United States Patent [19]

Korsunsky et al.

[11] Patent Number: 5,013,257

[45] Date of Patent: May 7, 1991

[54] CIRCUIT BOARD CONNECTOR HAVING IMPROVED LATCHING SYSTEM

[75] Inventors: Iosif Korsunsky, Harrisburg; Richard C. Schroepfer, Thompsontown, both of Pa.

[73] Assignee: AMP Incorporated, Harrisburg, Pa.

[21] Appl. No.: 544,458

[22] Filed: Jun. 27, 1990

[51] Int. Cl.[5] ..... H01R 13/00

[52] U.S. Cl. ..... 439/326

[58] Field of Search ..... 439/296, 326, 629–637

[56] References Cited

U.S. PATENT DOCUMENTS

| | | | |
|---|---|---|---|
| 3,718,895 | 2/1973 | Reynolds et al. | 339/258 R |
| 3,784,955 | 1/1974 | Reynolds et al. | 339/17 R |
| 3,803,533 | 4/1974 | Taplin | 339/91 |
| 3,920,303 | 11/1975 | Pittmann et al. | 339/91 R |
| 4,090,037 | 3/1978 | Kunkle et al. | 339/258 R |
| 4,129,351 | 12/1978 | Sugimoto et al. | 339/176 MP |
| 4,362,353 | 12/1982 | Cobaugh et al. | 339/258 P |
| 4,384,757 | 5/1983 | Andrews, Jr. et al. | 339/258 R |
| 4,709,302 | 11/1987 | Jordan et al. | 361/388 |
| 4,713,013 | 12/1987 | Regnier et al. | 439/62 |
| 4,722,700 | 2/1988 | Kuhn et al. | 439/629 |
| 4,737,120 | 3/1988 | Grabbe et al. | 439/326 |
| 4,781,612 | 11/1988 | Thrush | 439/328 |
| 4,850,891 | 7/1989 | Walkup et al. | 439/326 |
| 4,850,892 | 7/1989 | Clayton et al. | 439/326 |
| 4,946,403 | 8/1990 | Billman et al. | 439/326 |

FOREIGN PATENT DOCUMENTS

| | | | |
|---|---|---|---|
| 0093510 | 11/1983 | European Pat. Off. | 13/627 |
| 2258760 | 1/1974 | France | 7/12 |

*Primary Examiner*—Joseph H. McGlynn
*Attorney, Agent, or Firm*—Bruce J. Wolstoncroft; Frederick W. Raring

[57] ABSTRACT

Edge connector for a circuit board has stamped and formed latch members at each end of the connector housing. The circuit board extends at an acute angle from the board receiving face of the housing when the board is in its fully inserted functional position. Each latch member is U-shaped and has one arm which has a shoulder. The shoulders overlap side edge portions of the board and are directed towards the board receiving face. The housing has internal support members which are against the bight portions of the U-shaped latch members thereby to enhance the board retaining effect of the latch members. Each latch member has a convex camming surface along which the edge of the board moves when the board is pivoted from an initial insertion position to its functional position.

20 Claims, 6 Drawing Sheets

CIRCUIT BOARD CONNECTOR HAVING IMPROVED LATCHING SYSTEM

FIELD OF THE INVENTION

This invention relates to electrical connectors having stamped and formed metal latches for latching an inserted circuit board to the connector housing. The invention is particularly concerned with connectors of the type which receive the circuit board with the plane of the board extending at a first acute angle relative to the board receiving face of the connector and which requires pivoting of the board to a functional position in which it extends at a second acute angle which is less than the first acute angle.

BACKGROUND OF THE INVENTION

It is common practice to provide latches on edge connectors for circuit boards for latching the circuit board to the connector housing when it has been inserted and is in its functional position. Under some circumstances, the latches can be integrally molded as part of the housing; however, integral plastic latches have shortcomings in that they are subject to breakage or other damage and they may not provide sufficient retaining force for some circumstances, particularly where the connector housing contains a large number of contact terminals which exert relatively high forces on the circuit board. Accordingly, it is common practice also to provide stamped and formed metal latches for retaining the circuit board in its functional position in the connector housing. In accordance with one aspect thereof, the invention is directed to the achievement of an improved metal latch for a circuit board edge connector which is capable of exerting relatively high retention forces on the inserted circuit board and which is not subject to damage as a result of careless or other inappropriate handling.

One known type of circuit board connector requires insertion of the edge portions of the circuit board into the connector housing with the plane of the board extending at a first acute angle relative to the board receiving face of the housing and requires pivotal movement of the circuit board to its functional position in which it extends at a second acute angle which is less than the first acute angle. Again, connectors of this type have been produced which have integral plastic latches which may be satisfactory under some circumstances but which are inadequate for conditions where a large number of contact terminals are contained in the connector housing and where relatively high forces are imposed on the circuit board by the terminals when the circuit board is in its fully inserted functional position. In accordance with a further aspect thereof, the invention is directed to the achievement of an improved connector latching system for circuit boards which require such pivotal movement of the board when it is moved from its insertion position to its functional position.

THE INVENTION

In accordance with one aspect thereof, the invention is an electrical connector housing having opposite ends, a board receiving face, and a mounting face which is directed oppositely with respect to the board receiving face. In use, the connector is placed on a printed circuit mother board with the mounting face against the surface of the mother board. A trough-like recess extends into the board receiving face and between the ends.

Each of the ends has a latch receiving cavity extending into the board receiving face and a stamped and formed latch member is contained in each of these cavities. Each latch member is generally U-shaped and has first and second arms which extend from a bight. The first arm of each latch member is proximate to the recess and is flexible towards the second arm to permit insertion of edge portions of a circuit board into the recess. The first arm of each latch member has shoulder means which engages the board after insertion and retains the board in the recess. The connector is particularly characterized in that each of the latch receiving cavities has an integral support member extending thereacross and between the arms of the latch member. The bight portion of each latch member is between the support member and the mounting face and the support members are adjacent to the bight portions of the cavities so that upon flexure of the first arms towards the second arms during insertion of a circuit board into the recess, the bight portions are supported by the support members and the board retaining effect of the latch members is thereby enhanced. In the preferred embodiment, each of the latch receiving cavities extends through the housing from the board receiving face to the mounting face and each of the support members has a shoulder thereon which is proximate to a cavity sidewall and which is directed towards the board-receiving face. Each of the latch members has a locking ear which is against its associated shoulder. The latch members are assembled to the housing by insertion of the latch members into the cavities from the mounting face towards the board receiving face of the housing and the second arms are between the support members and the one sidewall.

A preferred embodiment of the invention comprises a connector of the type which receives the edge portions of the circuit board with the plane of the circuit board extending at a first acute angle with respect to the board receiving face of the connector housing. After the circuit board is in its insertion position, it is pivotally moved relative to the board receiving face until the plane of the board extends at a second acute angle which is less than the first acute angle. Each latch member comprises a latch arm having a fixed end, an adjacent portion, an intermediate transition portion, and an end portion. The adjacent portion extends from the fixed end of the arm to the transition portion and the end portion extends from the transition portion to a free end. The fixed end is in the housing and the latch arms extend substantially normally of the board receiving face. The intermediate portion of each latch arm has a board engaging shoulder which is directed towards the board receiving surface of the connector housing. The end portion has a board engaging camming surface which extends from the shoulder towards the free end and which is engaged by side edge portions of the board when it is moved from its insertion position to its functional position. The camming surface is a convex surface which is formed at the juncture of two planar sections which extend from the intermediate portion of the latch member.

THE DRAWING FIGURES

FIG. 1 is a plan view of a circuit board edge connector in accordance with the invention.

FIGS. 2 and 3 are views looking in the direction of arrows 2—2, 3—3, and 4—4 of FIG. 1.

FIGS 8, 9, 10, and 11 are perspective views of one of the latch members, each of these views showing the latch member in a position rotated 90 degrees about a vertical axis from its position as shown in the previous view.

Figure 1:
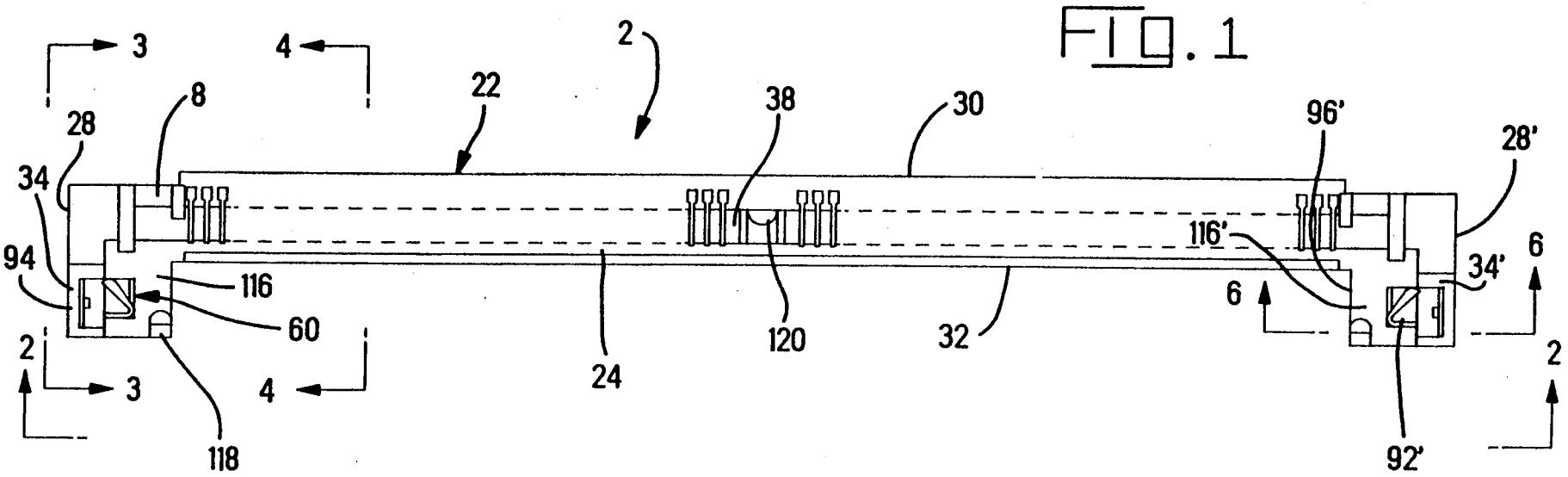
Figure 2:
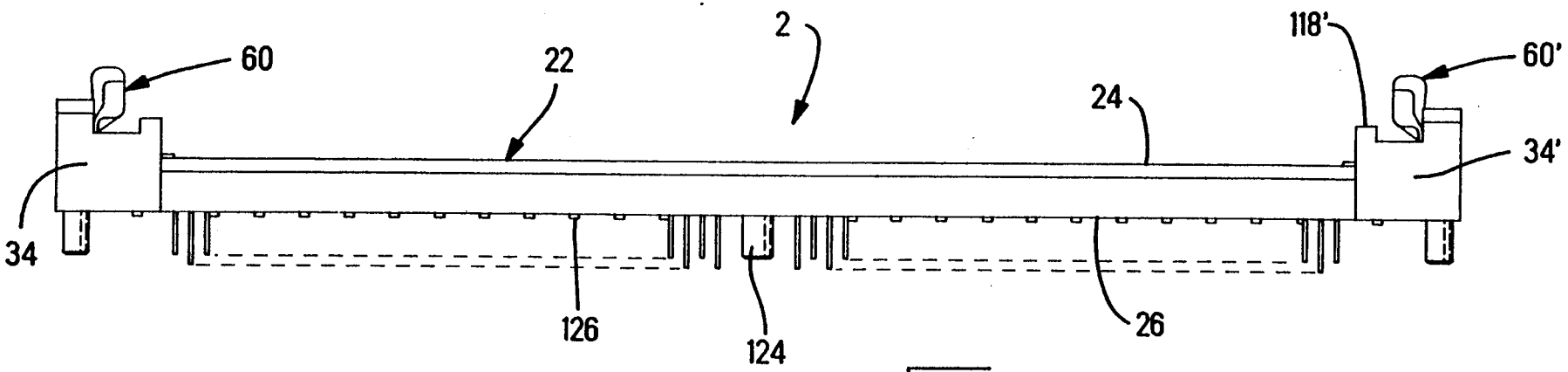
Figure 3:
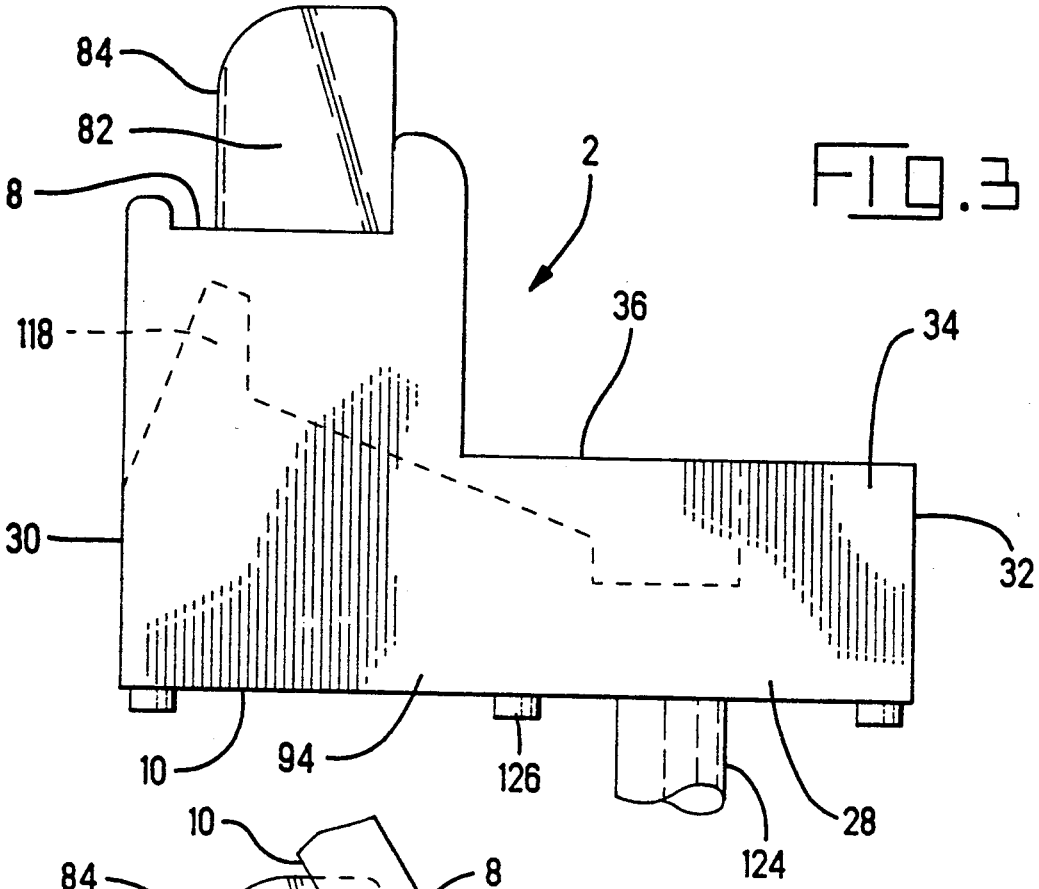
Figure 12:
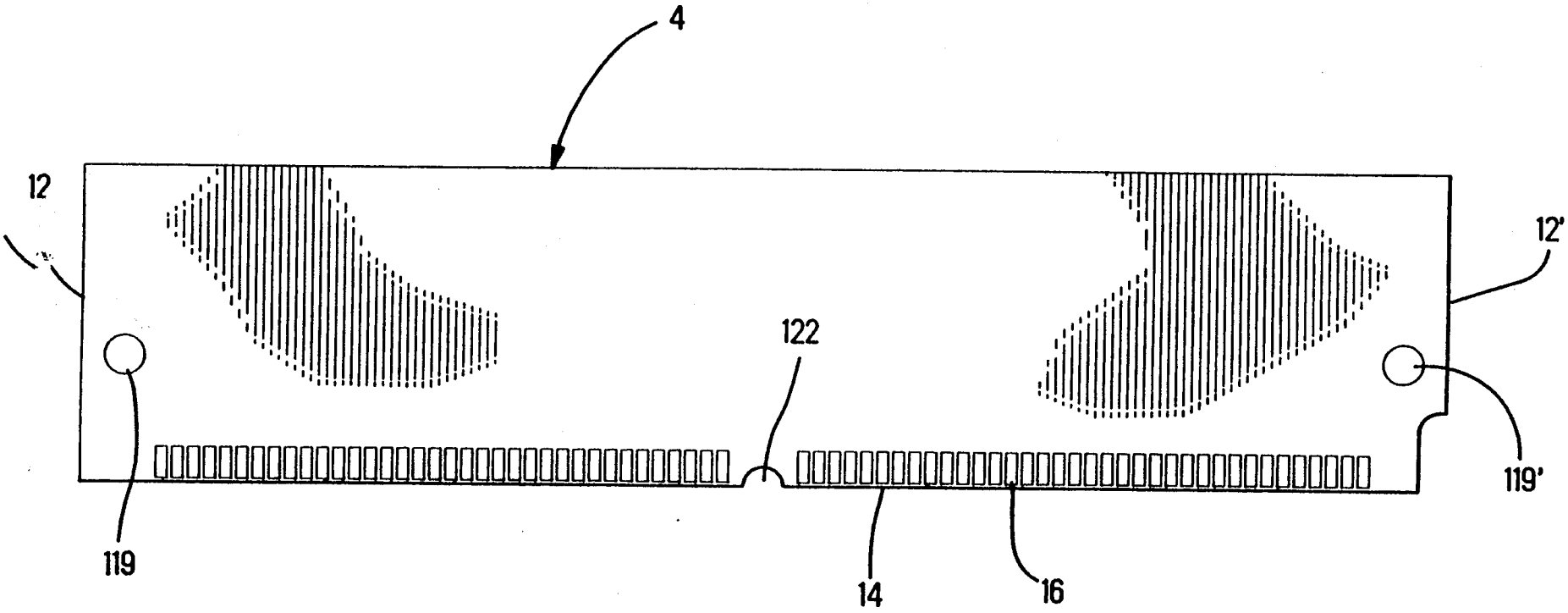

FIG. 12 is a plan view of a first circuit board which is received by the connector of FIG. 1.

Figure 13:
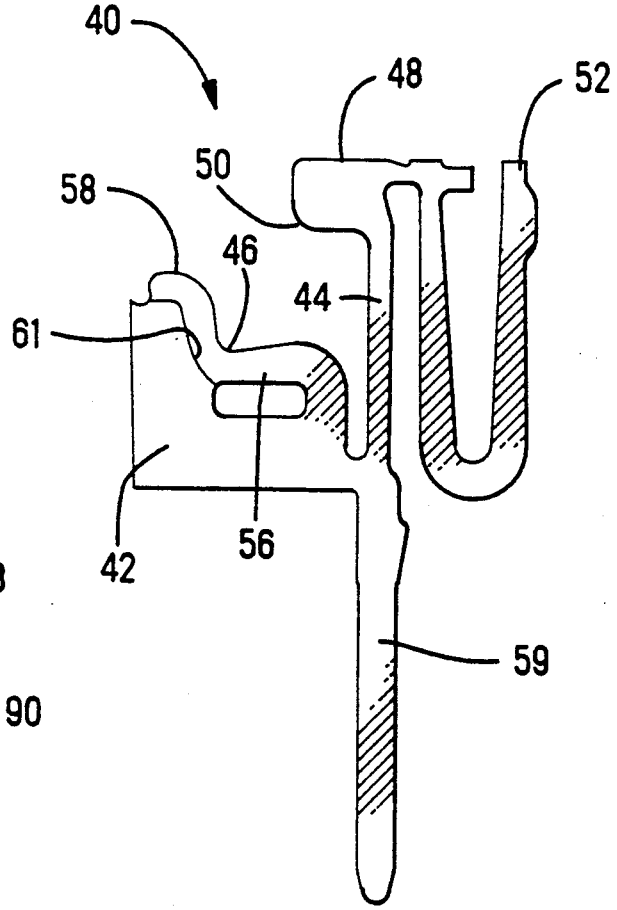

FIG. 13 is a plan view of one of the contact terminals contained in the connector housing.

THE DISCLOSED EMBODIMENT

A connector assembly 2, in accordance with the invention, FIGS. 1–5, serves to connect terminal pads 16 on a first circuit board 4 (FIG. 12) to conductors on a second circuit board 6 on which the connector assembly 2 is mounted. The circuit board 4 has upper and lower surfaces 8, 10 as viewed in the drawing, parallel side edges 12, 12', and a mating edge 14 which extends between the side edges and which is received in the connector housing. The terminal pads 16 are provided along the mating edge 14 on both of the surfaces 8, 10. The circuit board 6 has upper and lower surfaces 18, 20 and the connector assembly 2 is shown as being mounted on the upper surface with the terminals in the connector connected to conductors on the circuit board 6 by terminal posts 59. Alternatively, the connector assembly 2 may be surface mounted on the upper surface 18.

The connector assembly 2 comprises a molded insulating housing 22 having an upper board receiving surface 24, a lower surface 26 which serves as the mounting surface, opposite ends 28, 28' and side surfaces 30, 32 which extend between the ends. Extensions 34, 34' project from the ends 28, 28' and are provided with latch receiving cavities which receive the latching members 60, 60' for the first circuit board.

The upper surface 24 has a reduced height portion 36 which extends adjacent to the side 32 and a trough-like board receiving recess 38 extends between the ends and beside the reduced height portion. Spaced apart contact terminals 40 are contained in this trough-like recess for contacting the terminal pads on the circuit board. Each terminal, FIG. 13, comprises a generally L-shaped frame or base portion 42 having first and second contact arms 44, 46 extending therefrom. The first arm 44 of each contact terminal extends from the right-hand end of the base portion, as viewed in the drawing, and has an enlarged free upper end 48. An edge portion 50 of this enlarged free end serves as a contact surface for engagement with the terminal pads on the upper surface of the circuit board. A relatively strong and stiff U-shaped spring 52 is integral with the enlarged free end and has one arm which bears against an internal wall portion 54 of the trough-like recess 38. The second arm is serpentine and extends along a conforming edge 61 of the base portion. The base portion thus supports the second arm when the circuit board is in its inserted functional position. The contact surface on the second arm comprises an edge portion thereof as shown at 58. The terminal shown has an integral solder post portion 59 which extends through an opening in the second circuit board 6 and is adapted to be soldered to a conductor on the under side of the board. Mounting posts 124 are provided for locating the housing on the second circuit board and standoffs 126 are provided so that the mounting surface will be elevated above the surface 18 of the second circuit board.

Figure 4:
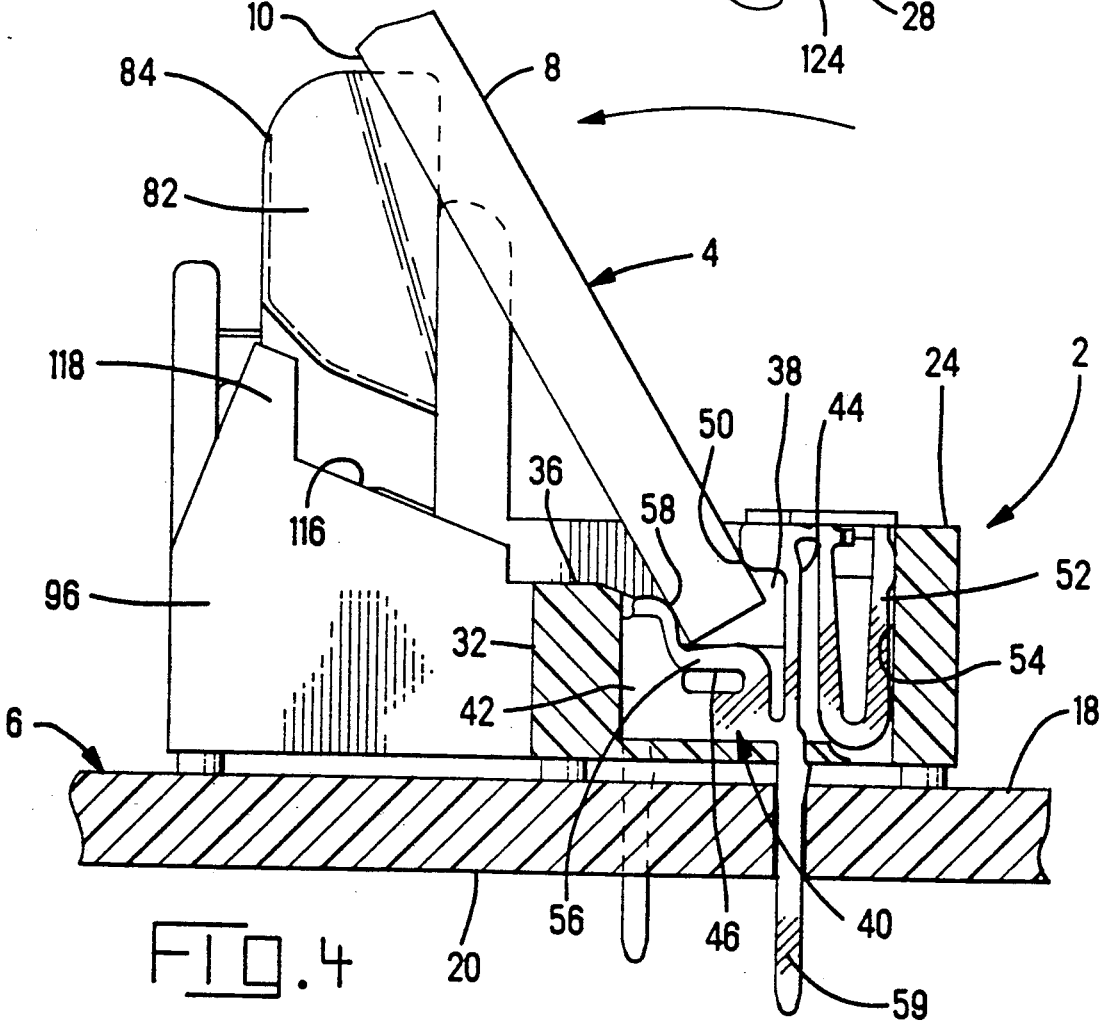
FIG. 4 is a sectional view looking in the direction of the arrows 4—4 of FIG. 1 but showing the connector mounted on a second circuit board and showing a first circuit board positioned in the board receiving recess of the connector housing in its insertion position.
Figure 5:
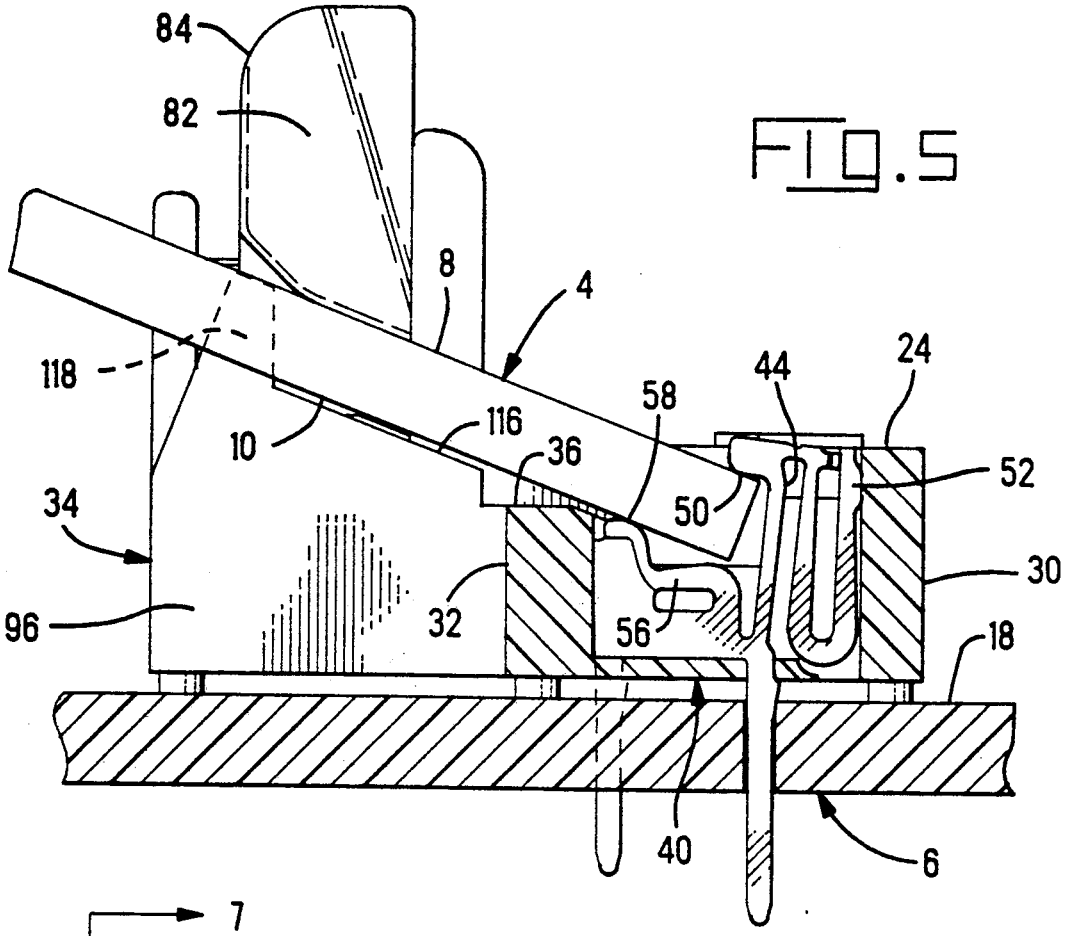
FIG. 5 is a view similar to FIG. 4 but showing the positions of the parts after the inserted first circuit board has been pivoted to its functional position.

As shown in FIGS. 4 and 5, the circuit board 4 is initially inserted into the trough-like recess 38 at a first acute angle relative to the upper surface 24 of the housing and relative to the surface 18 of the second circuit board 6. The circuit board 4 is then pivotally moved to a functional position as shown in FIG. 5 in which it extends at a second acute angle which is less than the first acute angle. When the circuit board is in its functional position, FIG. 5, it must be latched in the position shown in order to maintain the contact portions 50, 58 of the terminals 40 in engagement with the terminal pads and to prevent clockwise movement of the first circuit board from its functional position. The connector assembly will frequently contain a relatively large number of contact terminals and each terminal exerts, through the first arm 44 and the first contact portion a relatively high force on the upper surface of the circuit board tending to pivot the board about the contact portion 58 of the second arm 46 in a clockwise direction from the position shown in FIG. 5. Collectively, the terminals exert an extremely high force on the circuit board and it is necessary to provide latches to secure the board in its functional position, FIG. 5. The latching means, in accordance with the present invention, will now be described.

The latching means comprises a pair of stamped and formed latch members 60, 60' which are mounted in the extensions at the ends of the connector housing. The latch members 60, 60' are mirror images of each other and the same reference numerals, differentiated by prime marks, will be used to identify corresponding structural features in the two latch members. In the description which follows, the unprimed reference numerals of the latch member 60 are used exclusively, although some of the drawings show the latch member 60'.

Each latch member comprises first and second arms 62, 64 which extend from a circular bight 66. The bight 66 extends tangentially at 68 from the second arm 64 through an angle of about 270 degrees and merges at 70 with the first arm 62. The first arm has an adjacent portion 72 which is adjacent to the bight, an intermediate transition portion 74, and an end portion 76 which extends from the transition portion to a free end. The transition portion comprises a generally triangular ear 78 which extends laterally outwardly from the transition portion. Ear 78 is inclined upwardly from side edge 73 to side edge 75 so that the underside 86 of the ear provides an inclined downwardly facing shoulder as shown in FIG. 5. Vertical planer sections 80, 82 extend from the sides of the ear 78 and are joined to each other along a convex curved surface 84. This convex curved surface functions as a camming surface which extends from the upper free end of the planar sections to the triangular ear and this curved surface is engaged by a side edge 12 of the circuit board 4 when it is pivoted from its insertion position, FIG. 4, to its functional position, FIG. 5. The ear overlaps the side edge 12 of the circuit board 4 when the board is in its functional position, FIG. 5.

The second arm has a free end 88 and a retention lance 90 which extends from a location adjacent to the free end downwardly and inwardly towards the first arm.

The latches are received in latch cavities 92, 92' which extend through the extensions 34, 34' from the board receiving surface to the mounting surface. The extensions have external side surfaces 94, 94' which extend from the end walls 28 and opposed extension side surfaces 96, see FIGS. 4 and 6.

Figure 6:
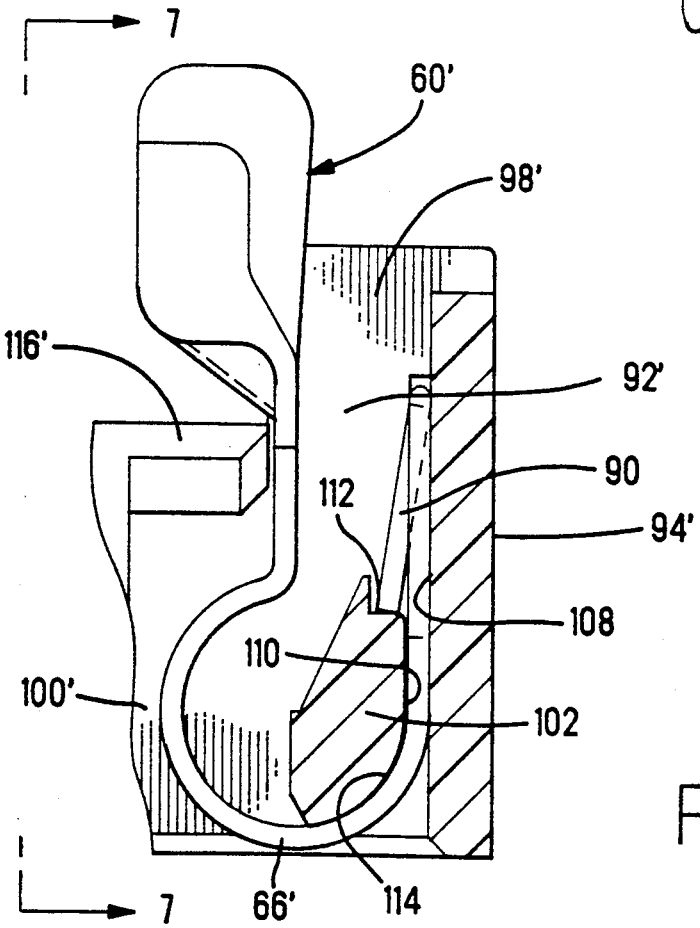
FIG. 6 is a cross-sectional view looking in the direction of the arrows 6—6 in FIG. 1.
Figure 7:
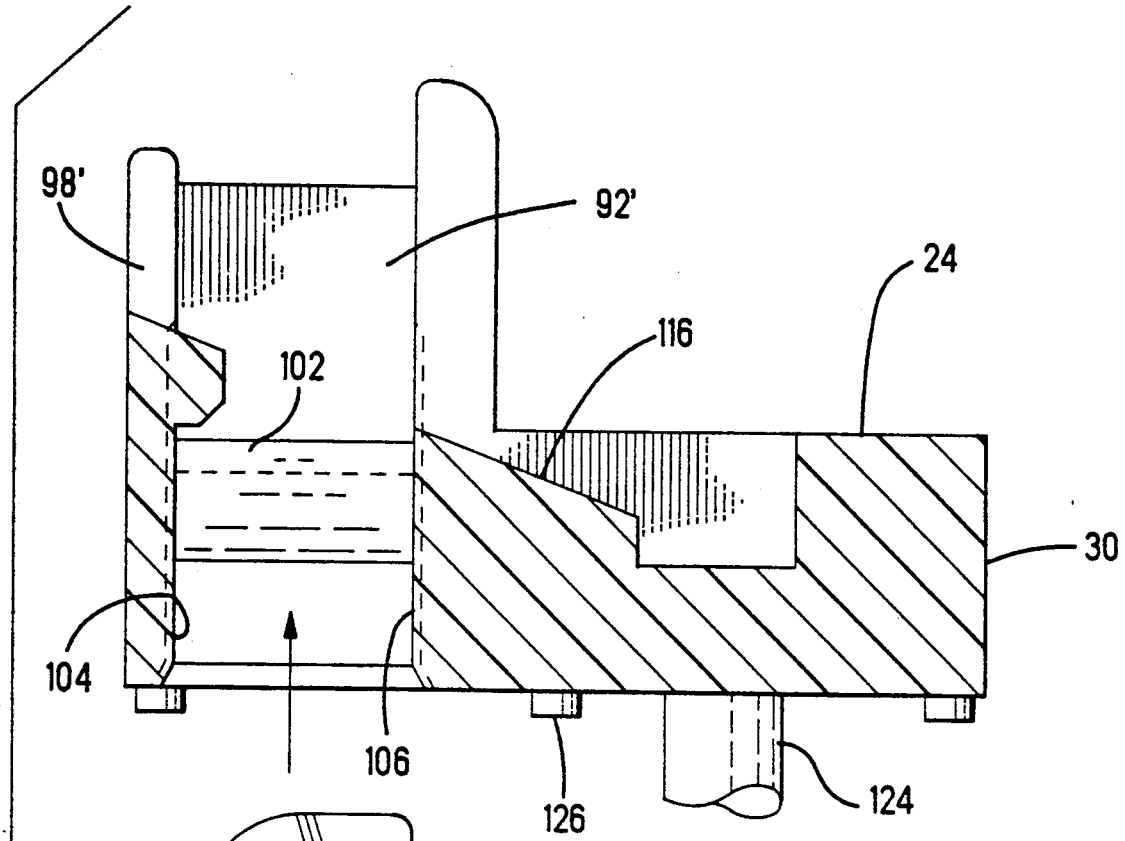
FIG. 7 is a view looking in the direction of the arrows 7—7 of FIG. 6 but showing the latch member exploded from the latch receiving cavity in the connector housing.
Figure 7:
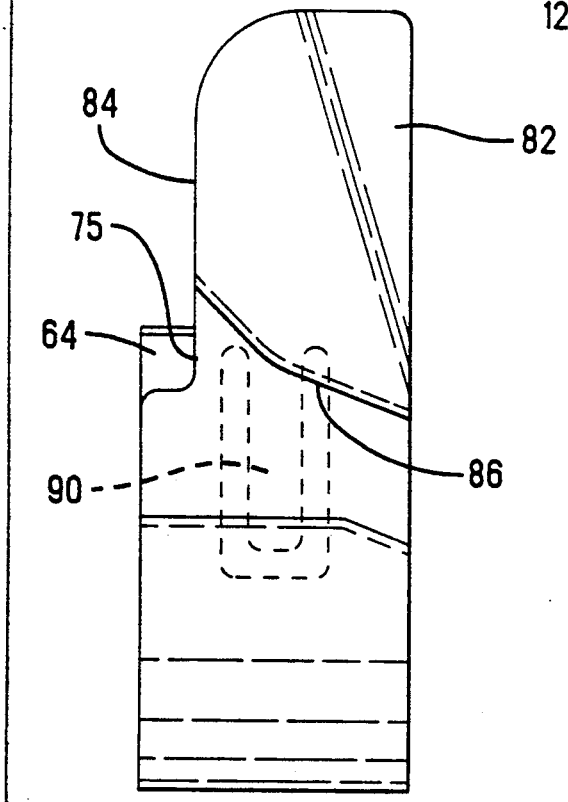
Figure 8:
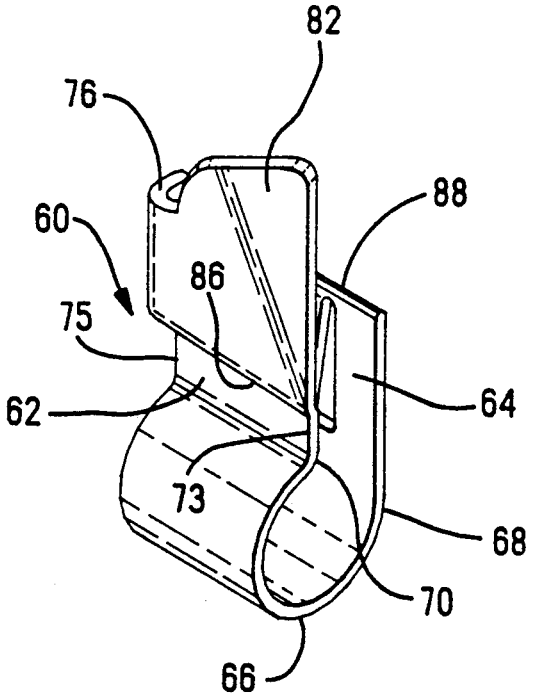
Figure 9:
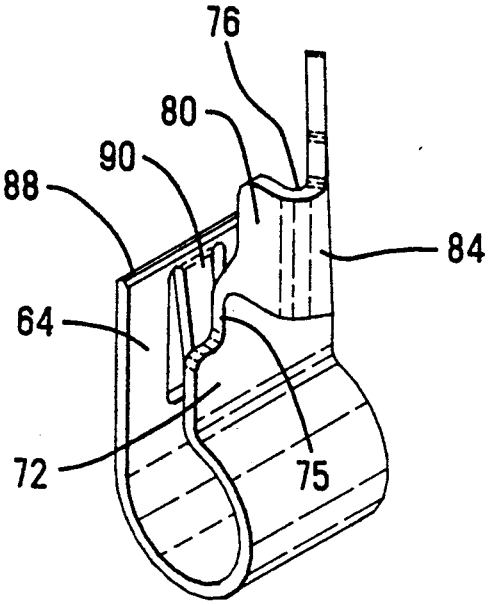
Figure 10:
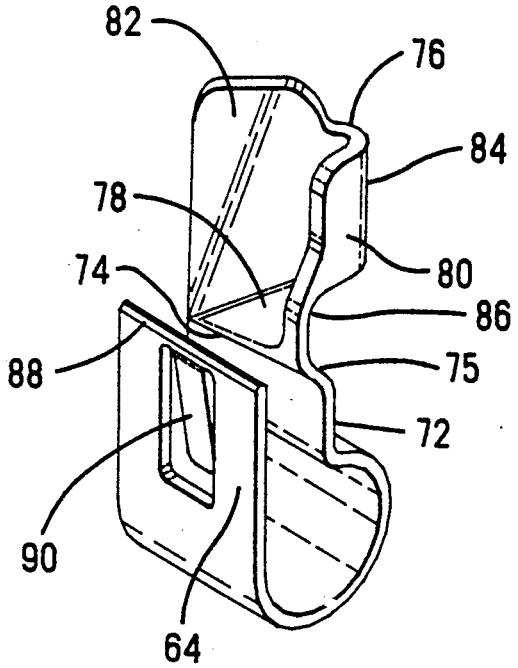
Figure 11:
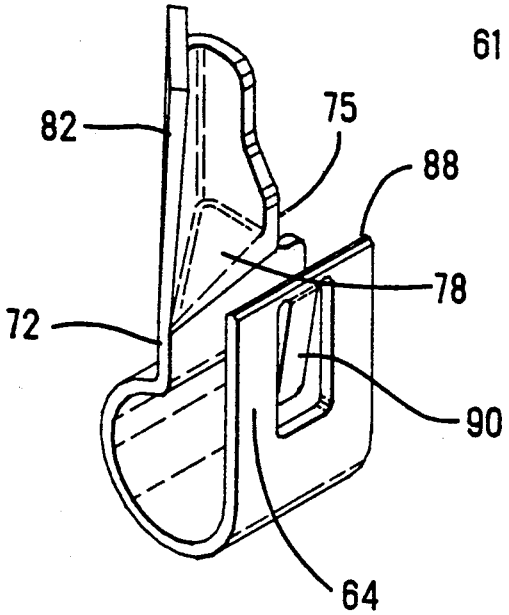

Each cavity has an upper end 98, and an enlarged lower end 100 which is capable of accommodating freely the circular bight portion 66 of the associated latch member. Each cavity further has an integral support 102 extending therethrough between opposed internal cavity walls 104, 106. These support members 102 are provided with upwardly, as viewed in FIG. 6, directed shoulders 112 against which the end of the associated lance 90 is supported when the latch member is assembled to the housing. Each support 102 has a surface 110 which is parallel to an adjacent internal surface 108 of the cavity but spaced therefrom by a distance sufficient to accommodate the thickness of the second arm of the latch member. The support member also has a curved surface 114 which is opposed to, and which conforms to, the curved surface the bight of the latch member. As shown in FIG. 6, the support member is thus against a portion of the bight of the latch member and when the first arm is flexed outwardly (rightwardly in the case of the latch member 60' shown in FIG. 6) during the pivotal movement of circuit board 4 from its insertion position to its functional position flexure takes place in the portion of the bight 66 which extends from the support 102 to the adjacent portion 72 of the first arm 62.

The extensions 34, 34' have upwardly facing inclined surfaces 116, 116' which are between the latch receiving cavities 92, 92' and the opposed side surfaces 96, 96'. Surfaces 116, 116' are substantially parallel to the shoulder surfaces 86, 86' and the circuit board 4 is clamped between the shoulder surfaces and the surfaces 116, 116' when it is in its functional position, FIG. 5. Locating bosses 118, 118' extend upwardly from the surfaces 116, 116' and are received in openings 119, 119' in the circuit board. Additionally, a locating boss 120 is provided on the housing between the ends thereof and serves to locate the board by means of a notch 122 in the mating edge.

After the connector assembly 2 has been installed on the upper surface 18 of the circuit board 6, either by means of mounting posts and standoffs as shown or by surface mounting techniques, the circuit board 4 is assembled to the connector assembly 2 by inserting the mating edge portion into the recess 38 at a first acute angle as shown in FIG. 4. The connector is of the low insertion force type or the zero insertion force type in that very little force is required to place the circuit board 2 in the position shown in FIG. 4. After initial insertion, the circuit board is pivoted downwardly in a counter-clockwise direction in FIG. 4 so that the side edges 12, 12' move along the convex camming surfaces 84, 84' and flex the first arms of the latch members outwardly until the lower surface of the circuit board is against the surface 116 at which time first arms 62, 62' the latch members will return towards their normal positions and the shoulders 86 will extend over portions of the circuit board adjacent to the side edges. The supports 102 provide extensive bearing surfaces for the stressed portions of the latch members. By virtue of the form of the latch members and by virtue of the provision of the support members in the latch receiving cavities, the latch members can have an extremely high retention force which is exerted through the shoulders 86 against the upper surfaces of the circuit board 4. Because of the fact that the latch members are extremely strong and exert a high retaining force on the circuit board, a large number of contact terminals can be provided in the connector assembly 2 with each terminal exerting relatively high contact forces on its associated terminal pad. The foregoing advantages are achieved in a type of connector, having circuit boards which extend at an acute angle from the connector assembly. The latch members are extremely robust and are resistant to damage as a result of careless or negligent handling by a technician installing the connectors on a circuit board 6 or during insertion of the board 4 into the connector assembly.

The convex camming surfaces 84, 84' of the latch members are advantageous in that, unlike a sheared edge, they do not score or otherwise damage the side edges 12, 12' of circuit board 4 when the circuit board is pivoted to its functional position.

SUMMARY STATEMENT OF ADVANTAGES

Practice of the invention permits the use of stamped and formed latch members in electrical connector assemblies for double-sided printed circuit daughter boards having terminal pads on both of the surfaces thereof. The invention specifically provides relatively high normal forces on the circuit board when the daughter board is in its functional position so that the contact terminals can exert a relatively high contact force on the terminal pads of the circuit board. These advantages are achieved in connectors of a type which have the inserted circuit board extending at an acute angle when the inserted board is in its functional position.

We claim:

1. An electrical connector comprising an insulating housing having opposite ends, a board-receiving face and a mounting face which is directed oppositely with respect to the board-receiving face, a trough-like recess extending into the board-receiving face and extending between the ends, each of the ends having a latch-receiving cavity which extends into the board-receiving face, a stamped and formed latch member in each of the cavities, each latch member being generally U-shaped and having first and second arms which extend from a bight, the first arm of each latch member being proximate to the recess and being flexible towards the second arm to permit insertion of edge portions of a circuit board into the recess, the first arm of each latch member having shoulder means which engages the board after insertion and retains the board in the recess, the connector being characterized in that:

each cavity has an integral support member extending thereacross between the arms, the bight portion of each latch member being between the support member and the mounting face, the support members being adjacent to the bight portions, whereby, upon flexure of the first arms towards the second arms during insertion of a circuit board into the recess, the bight portions are supported by the support members and the board retaining effect of the latch members is thereby enhanced.

2. An electrical connector as set forth in claim 1 characterized in that each of the latch receiving cavities extends through the housing from the board-receiving face to the mounting face, each of the support members has a shoulder thereon which is proximate to a cavity sidewall and which is directed towards the board-receiving face, each latch member has a locking ear which is against its associated shoulder, the latch members having been inserted into their respective cavities from the mounting face towards the board receiving face, the second arms being between the support members and the associated sidewalls.

3. An electrical connector as set forth in claim 2 characterized in that the bight portions are arcuate and each of the support members has an arcuate supporting surface which is opposed to the arcuate surface of the associated bight portion.

4. An electrical connector as set forth in claim 3 characterized in that each of the arcuate supporting surfaces has a radius of curvature which is substantially equal to the radius of curvature of the associated bight portion, each bight portion being against its associated supporting surface when the first arms are flexed.

5. An electrical connector as set forth in claim 4 characterized in that the bight portions extend through an arc of greater than 180 degrees.

6. An electrical connector as set forth in claim 1 characterized in that the connector is of the type which requires insertion of the board into recess with the board at a first acute angle relative to the board receiving face and which requires pivotal movement of the board towards the board receiving face to a functional position in which the board extends at a second acute angle with respect to the board receiving face, the second angle being less than the first angle.

7. An electrical connector as set forth in claim 6 characterized in that each first latch arm has an adjacent portion which is adjacent to the bight portion, an intermediate transition portion and an end portion, and the intermediate portion has a board engaging shoulder which is directed towards the board receiving face.

8. An electrical connector as set forth in claim 7 characterized in that the end portion has a board engaging camming surface which extends from the shoulder, the camming surface being inclined away from the shoulder and divergently with respect to the ends of the housing.

9. An electrical connector as set forth in claim 8 characterized in that the end portion of each first latch arm comprises first and second plane surfaces which extend convergently of each other and which are joined by a convex curved surface, the camming surface being the convex curved surface.

10. An electrical connector which is intended to receive the mating edge of a circuit board, the board having side edges which extend from the mating edge, the connector comprising an insulting housing having a board-receiving face and opposite ends at each end of the face, a board-receiving recess extending into the face and between the ends, spaced apart contact terminals in the recess, the recess and the terminals being of the type which receive the mating edge of the board in an insertion position in which the plane of the board is inclined at a first acute angle to the face and which require pivotal movement of the board towards the face to a functional position in which the board is inclined at a second acute angle with respect to the face, the second angle being less than the first angle, and latch means at the ends of the housing for latching the board in its functional position, the connector being characterized in that:

the latch means comprises a pair of stamped and formed sheet metal latch members, each of the latch members comprising a latch arm having a fixed end, an adjacent portion, an intermediate transition portion, and an end portion, the adjacent portion extending from the fixed end to the transition portion, the end portion extending from the transition portion to a free end, the fixed end being in the housing, the latch arms extending substantially normally of the board-receiving face, the intermediate portion of each latch arm has a board engaging shoulder which is directed towards the fixed end, and the end portion has a board-engaging camming surface which extends from the shoulder towards the free end whereby, upon placement of the mating edge of the board in the recess in its insertion position, the side edges of the board will be against the camming surfaces of the latch arms, and upon pivotal movement of the board to its functional position, the side edges will be moved along the camming surfaces to the shoulders with accompanying flexure of the arms, and upon arrival of the board at its functional position, the arms will return to their normal positions and the shoulders will move past the side edges of the board thereby retaining the board in its functional position.

11. An electrical connector as set forth in claim 10 characterized in that the end portion of each latch arm comprises first and second plane sections which intersect and are joined by a convex curved surface, the camming surface being on the convex curved surface.

12. An electrical connector as set forth in claim 10 characterized in that the intermediate portions of the latch arms comprise ears which extend laterally of the adjacent portions towards each other so that when the circuit board is in its functional position, the ears will extend past the side edges of the circuit board, the board engaging shoulders being surface portions of the ears.

13. An electrical connector as set forth in claim 10 characterized in that the circuit board extends laterally of the housing in one direction when in its insertion position and when in its functional position, and the housing has extensions at its ends projecting in the one direction, the latch members being mounted in the extensions and being spaced laterally from the recess in the one direction.

14. An electrical connector as set forth in claim 13 characterized in that the end portion of each of the latch arms comprises first and second plane sections which intersect and are joined by a convex curved section, the camming surface being on the convex curved section, the first plane section of each latch arm facing obliquely towards the housing, the camming surfaces being relatively remote from the housing, the first plane sections being between the camming surfaces and the housing.

15. An electrical connector as set forth in claim 13 characterized in that the extensions have inclined surfaces against which the circuit board is positioned when the circuit board is in its functional position, the angle of inclination being the second acute angle.

16. An electrical connector as set forth in claim 15 characterized in that the intermediate portions of the latch arms comprise ears which extend laterally of the adjacent portions towards each other so that when the circuit board is in its functional position, the ears will extend past the side edges, the board engaging shoulders being surface portions of the ears.

17. An electrical connector as set forth in claim 16 characterized in that the ears are inclined at the second acute angle whereby the edge portions of the board are clamped between the ears and the inclined surfaces of the extensions when the board is in its functional position.

18. An electrical connector as set forth in claim 16 characterized in that the end portion of each latch arm comprises first and second plane sections which intersect and are joined by a convex curved surface, the camming surface being on the convex curved surface.

19. An electrical connector as set forth in claim 18 characterized in that each of the latch members is generally U-shaped and has first and second arms which extend from a bight portion, the latch arms being the first arms of the U-shaped members, the latch members being contained in latch receiving cavities in the extensions with the first arms proximate to the recess, each of the cavities having an integral support member extending between the first and second arms and adjacent to the second arms.

20. An electrical connector as set forth in claim 19 characterized in that each of the bight portions extends through an arc of about 270 degrees, the bight portions extending tangentially from the second arms.

* * * * *